US005236350A

United States Patent [19]

Cummings, III et al.

[11] Patent Number: 5,236,350

[45] Date of Patent: Aug. 17, 1993

[54] CYCLONIC COMBUSTER NOZZLE ASSEMBLY

[75] Inventors: William G. Cummings, III; William P. Coppin; David A. Jarvis, all of Muncie, Ind.

[73] Assignee: Maxon Corporation, Muncie, Ind.

[21] Appl. No.: 792,720

[22] Filed: Nov. 15, 1991

[51] Int. Cl.[5] ..... F23C 5/32

[52] U.S. Cl. ..... 431/173; 431/177; 431/354; 239/399; 239/403

[58] Field of Search ..... 431/9, 173, 177, 350, 431/354, 348, 284, 285, 353; 239/403, 399

[56] References Cited

U.S. PATENT DOCUMENTS

| | | | |
|---|---|---|---|
| 1,771,875 | 7/1930 | Cowardin et al. | 239/399 |
| 2,096,765 | 10/1937 | Saha . | |
| 2,276,131 | 3/1942 | Wiant | 239/399 |
| 2,294,168 | 8/1942 | Francis et al. | 239/399 |
| 2,518,800 | 8/1950 | Lester . | |
| 2,594,312 | 4/1952 | Kerr et al. . | |
| 2,858,780 | 11/1958 | Sifrin et al. . | |
| 3,219,094 | 11/1965 | Lempa | 431/353 |
| 3,736,747 | 6/1973 | Warren . | |
| 3,915,619 | 10/1975 | Quigg et al. . | |
| 4,021,186 | 5/1977 | Tenner . | |
| 4,144,019 | 3/1979 | Lyshkow et al. . | |
| 4,177,740 | 12/1979 | Lamb et al. . | |
| 4,379,689 | 4/1983 | Morck | 431/348 |
| 4,385,490 | 5/1983 | Schirmer et al. . | |
| 4,400,151 | 8/1983 | Vatsky . | |
| 4,598,553 | 7/1986 | Saito et al. . | |
| 4,651,534 | 3/1987 | Stroem . | |
| 4,683,541 | 7/1987 | David . | |
| 4,690,635 | 9/1987 | Coppin . | |
| 4,828,487 | 5/1989 | Earl | 431/285 |
| 5,013,236 | 5/1991 | Khinkis . | |

FOREIGN PATENT DOCUMENTS

| | | | |
|---|---|---|---|
| 597392 | 5/1960 | Canada | 239/403 |
| 1134956 | 12/1956 | France . | |
| 869852 | 6/1961 | United Kingdom | 239/403 |

*Primary Examiner*—Carroll B. Dority
*Attorney, Agent, or Firm*—Barnes & Thornburg

[57] ABSTRACT

A nozzle is provided for discharging a combustible air and fuel mixture into the combustion chamber of a cyclonic combustor. The nozzle includes a centrally located air plenum and a plurality of passageways for discharging air from the plenum into the combustion chamber. The nozzle also includes a fuel jet system for discharging fuel into each air discharge passageway to mix with the combustion air passing therethrough.

31 Claims, 4 Drawing Sheets

CYCLONIC COMBUSTER NOZZLE ASSEMBLY

BACKGROUND AND SUMMARY OF THE INVENTION

This invention relates to low-emission burners, and particularly to air and fuel mixing nozzles for use in a burner assembly. More particularly, this invention relates to nozzles for discharging a combustible air and fuel mixture into the combustion chamber of a cyclonic combustor.

A cyclonic combustor is a burner which burns a swirling air and fuel mixture that travels at a predetermined velocity along a spiral or helical path inside a combustion chamber. Typically, the combustion chamber is an open cylinder and the air and fuel mixture is introduced through an inlet provided at one end for spiral travel toward an outlet provided at the other end. The swirling air and fuel mixture in the combustion chamber is ignited to produce a flame. In a cyclonic combustor, the fresh unburned air and fuel mixture introduced through the inlet into the combustion chamber continuously mixes with any undischarged products of combustion (e.g., oxides of nitrogen, carbon monoxide, etc.) remaining in the combustion chamber to produce a swirling combustible mixture of combustion air and fuel and products of combustion in the cyclonic combustion chamber.

A cyclonic combustor nozzle for producing a combustible fuel-lean air and fuel mixture which is ignitable in a cyclonic combustion chamber to yield low flame temperatures and low emissions of oxides of nitrogen would be a welcomed improvement over conventional nozzles of the type used in cyclonic combustor. Excess air is present in a fuel-lean air and fuel mixture to provide more material to absorb the heat of combustion so the flame temperature cannot go as high as with a perfect or stoichiometric air and fuel mixture. The oxides of nitrogen produced during combustion contribute to air pollution. Advantageously, low flame temperatures lead to low emissions of oxides of nitrogen.

According to the present invention, a cyclonic combustor nozzle is provided for mixing air and fuel to produce a combustible lean air and fuel mixture. The cyclonic combustor nozzle includes a nozzle body formed to include a fuel chamber and a combustion air chamber and means for conducting combustion air from the combustion air chamber through the nozzle body into a cyclonic combustion chamber of a cyclonic combustor at a predetermined velocity.

A fuel jet system is provided in the nozzle body to deliver fuel from the fuel chamber into the conducting means to mix with combustion air passing from the air chamber into the cyclonic combustion chamber. This fuel jet system produces a fuel-lean air and fuel mixture in the conducting means that is discharged from the nozzle body into the cyclonic combustion chamber. This fuel-lean mixture can be ignited to produce a flame having a low flame temperature which leads to low emissions of oxides of nitrogen and other contaminants.

In preferred embodiments, the nozzle body is formed to include a centrally located round air chamber and a ring-shaped fuel chamber surrounding the air chamber. The nozzle body is configured to connect to an air supply line and a fuel supply line so that combustion air can be supplied to the round air chamber and fuel can be supplied to the ring-shaped fuel chamber.

The nozzle body is also formed to include a plurality of separate discharge passageways for conducting combustion air from the air chamber into the cyclonic combustion chamber and receiving fuel delivered by the fuel jet system. Each discharge passageway extends outwardly from the round air chamber at an angle so that all of the discharge passageways are arranged in a somewhat pinwheel-shaped pattern about the round air chamber. This arrangement of the discharge passageways helps to establish the desirable swirling cyclonic flow pattern of the air and fuel mixture emitted from the discharge passageways into the cyclonic combustor.

The nozzle body is also formed to include many fuel jets that are located so that one or more fuel jets emit a stream of fuel from the fuel chamber into each of the discharge passageways. This fuel mixes with air traveling through the discharge passageway to produce a desirable fuel-lean air and fuel mixture. In preferred embodiments, the air and fuel mixture has an air-to-fuel ratio greater than 15 to 1. Advantageously, the fuel-lean air and fuel mixture produced by a cyclonic combustor nozzle in accordance with the present invention is ignitable in a cyclonic combustion chamber to yield a low flame temperature and lower the emission of unwanted oxides of nitrogen and other contaminants from the outlet of the cyclonic combustion chamber. It will be understood that a nozzle in accordance with the present invention is well suited for use in providing a combustible air and fuel mixture to any type of burner housing.

Also, the fuel jets formed in the nozzle body are configured and arranged to produce a uniformly distributed fuel-lean air and fuel mixture in each discharge passageway. Advantageously, this enhanced mixing in the nozzle body acts to minimize any zones of (1) perfect or stoichiometric air and fuel mixtures or (2) fuel-rich air and fuel mixtures in the discharge passageway and thereby minimize the later formation of zones or pockets of such mixtures in the cyclonic combustion chamber, thereby reducing the likelihood that "hot spots" will develop in the cyclonic combustion chamber.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
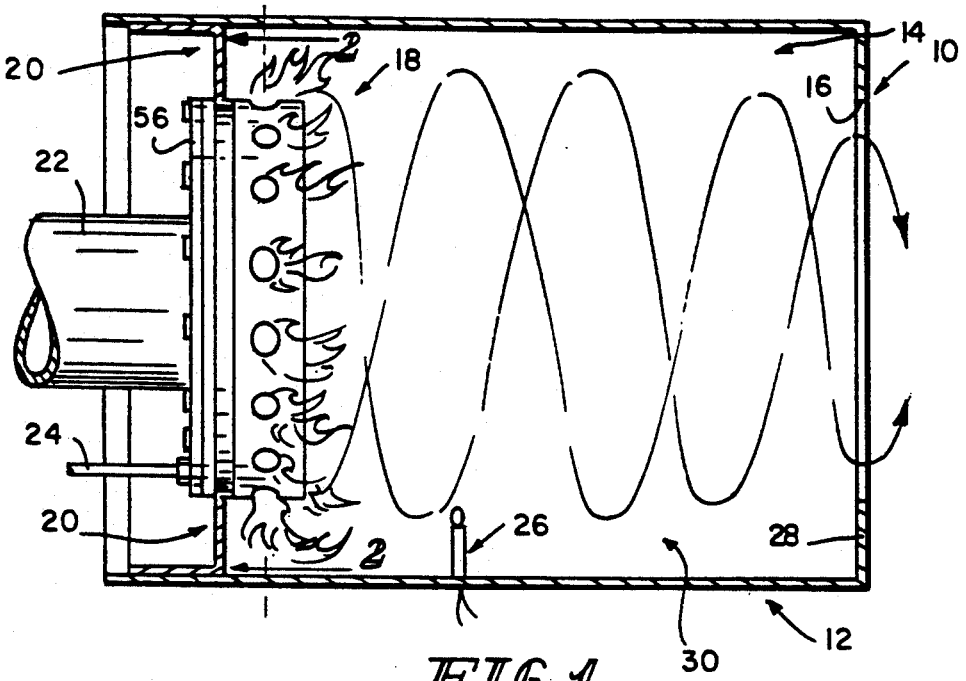
FIG. 1 is a sectional view of a cyclonic combustor showing a nozzle mounted at one end to discharge a swirling air and fuel mixture into a combustion chamber and an exhaust outlet formed at the opposite end.

A cyclonic combustor assembly 10 includes a housing 12 providing a combustion chamber 14 and an exhaust outlet 16, a nozzle assembly 18, a nozzle support bracket 20, a combustion air supply line 22, and a fuel supply line 24 as shown in FIG. 1. The innovative nozzle assembly 18 in accordance with the present invention mixes combustion air supplied through line 22 and fuel supplied through line 24 to produce a combustible fuel-lean air and fuel mixture that is discharged into cyclonic combustion chamber 14. An ignitor means 26 of any conventional or suitable type is used to ignite the air and fuel mixture swirling about in the cyclonic combustion chamber 14.

The swirling air and fuel mixture and the exhaust outlet 16 formed in a downstream end 28 of housing 12 combine to create a vortex 30 within the cyclonic combustion chamber 14. In this vortex 30, the fuel-lean air and fuel mixture discharged by nozzle assembly 18 and any products of combustion remaining in chamber 14 whirl about in a spiral pattern as shown diagrammatically in FIG. 1. It will be understood that the vertical pressure field developed in cyclonic combustion chamber 14 recirculates a portion of the combustion gases present in chamber 14 to provide good flammability and burnout of carbon monoxide and unburned hydrocarbons. The lip 28 on housing 12 restricts flow out of chamber 14 through outlet 16 to create back pressure in chamber 14 and cause recirculation of products of combustion back toward nozzle assembly 18 and into the main flame zone in cyclonic combustion chamber 14. It will be understood that cyclonic flow can be either clockwise or counterclockwise.

Figure 2:
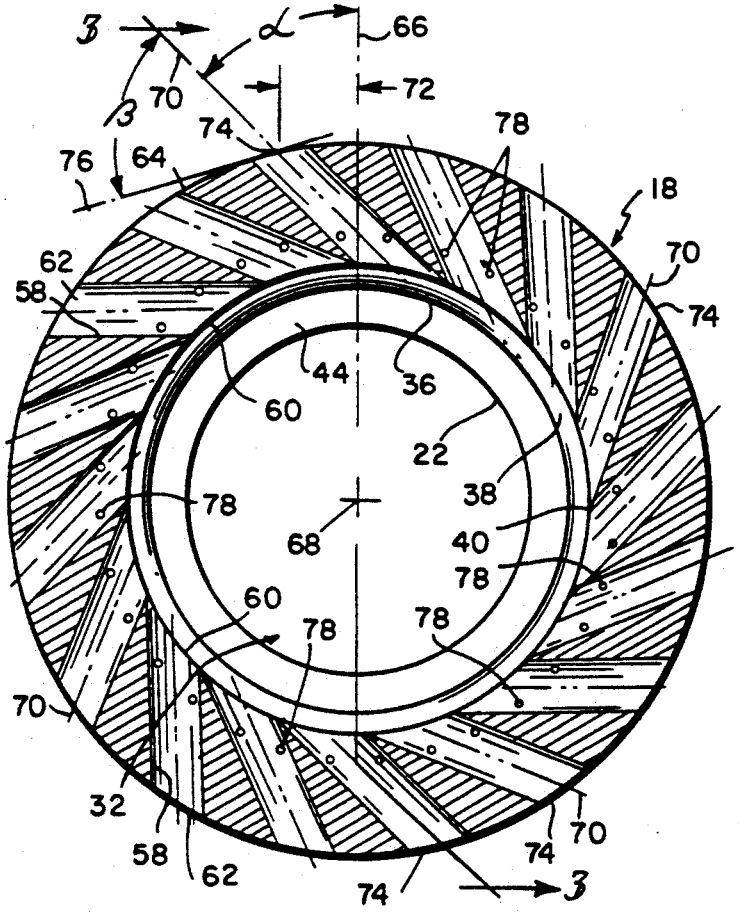
FIG. 2 is a sectional view of the nozzle of FIG. 1 showing a round air plenum, a plurality of discharge passageways arranged in a pinwheel-shaped pattern, and a plurality of pairs of fuel jet ports for emitting streams of fuel into air passing through each of the discharge passageways.
Figure 3:
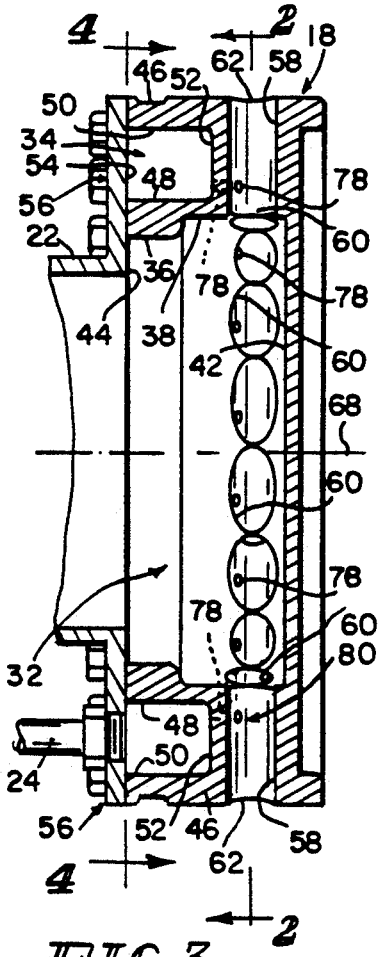
FIG. 3 is a sectional view of the nozzle of FIGS. 1 and 2 taken along line 3—3 of FIG. 2 showing the centrally located air plenum coupled to a combustion air supply line, an annular fuel plenum coupled to a fuel supply line, the discharge passageways for discharging air from the air plenum out of the nozzle body, and the fuel jets for emitting fuel from the fuel plenum into each of the discharge passageways.
Figure 4:
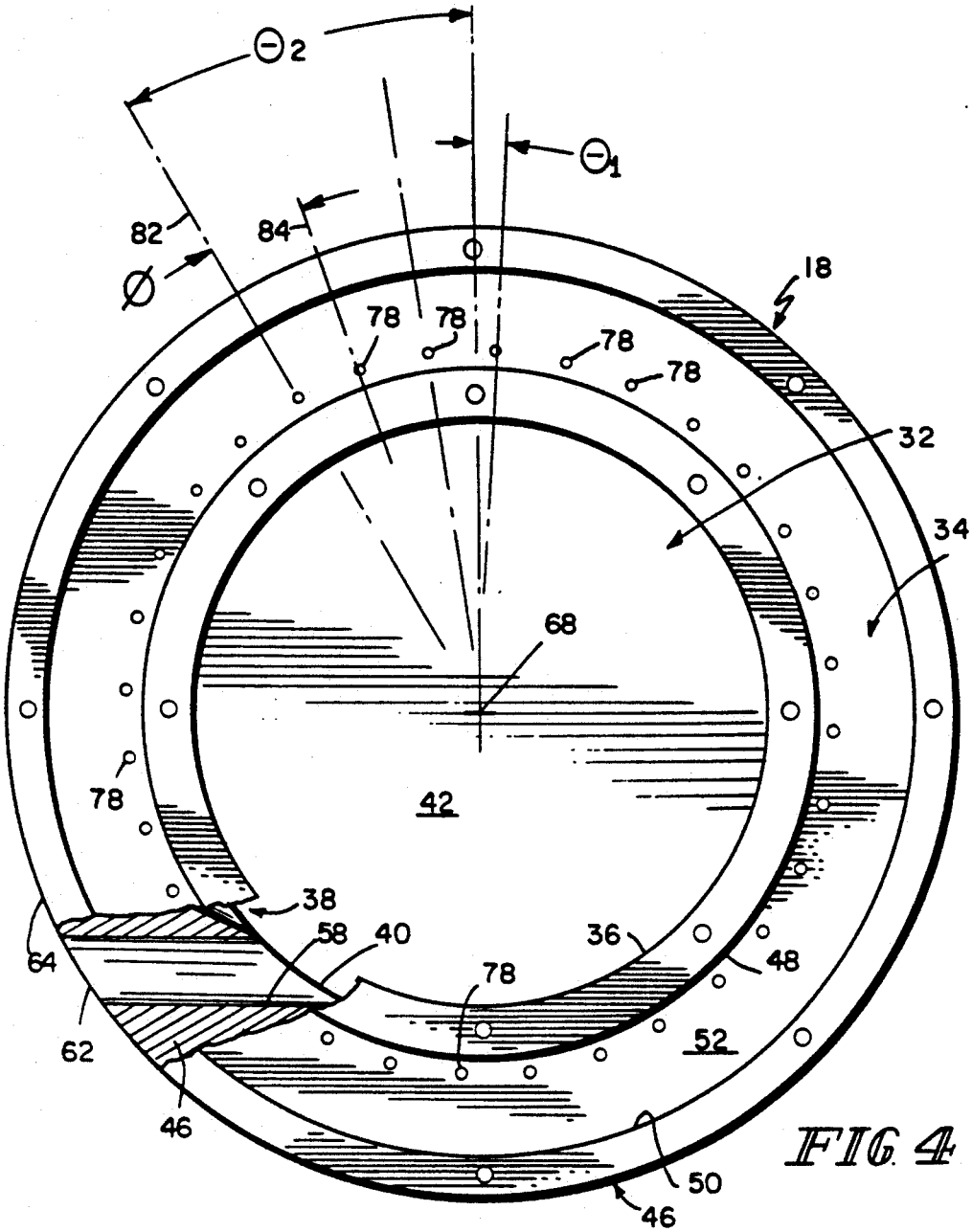
FIG. 4 is a plan view of the nozzle body taken along line 4—4 of FIG. 3 showing the round air plenum and the annular fuel plenum and with portions broken away to show a discharge passageway underneath the annular fuel plenum.

Nozzle 18 is formed to include a central air plenum 32 and an annular fuel plenum 34 surrounding the central air plenum 32 as shown in FIGS. 2–4. The air plenum 32 provides a round space in the center of nozzle 18 and receives combustion air conducted through the combustion air supply line 22 by a blower (not shown). Any suitable source of combustion air may be used to provide air to air plenum 32. The nozzle 18 includes a first inner side wall 36, a lip 38, a second inner side wall 40, and a bottom wall 42 that cooperate with a lip 44 on air supply line 22 to form air plenum 32 as shown best in FIG. 3. The nozzle 18 includes an outer ring portion 46 that is formed to include a first annular side wall 48, a second annular side wall 50, and an annular bottom wall 52 extending therebetween as shown best in FIGS. 3 and 4. These walls 48, 50, and 52 cooperate with an inner surface 54 on mounting plate 56 to form fuel plenum 34 as shown best in FIG. 3.

As shown in FIGS. 2–4, the outer ring portion 46 of nozzle 18 is formed to include a plurality of angled discharge passageways 58 for conducting combustion air from air plenum 32 into cyclonic combustion chamber 14. Each discharge passageway 58 is a tubular passage having an inlet 60 formed in the second inner side wall 40 in air plenum 32 and an outlet 62 formed in an exterior side wall 64 of nozzle 18. The discharge passageways 58 are illustratively arranged in a pinwheel-shaped pattern about the round air plenum 32 to impart a swirling motion to air discharged into the cyclonic combustion chamber 14 from air plenum 32 through discharge passageways 58. It will be understood to one of ordinary skill in the art that it is within the scope of this invention to vary the number, angle, arrangement, shape, cross-section, and size of the discharge passageways 58 to suit the application and enhance operation of cyclonic combustor assembly 10.

A presently preferred configuration of discharge passageways 58 is shown in FIG. 2. A radially extending reference line 66 extends outwardly from center point 68 and a longitudinally extending reference line 68 extends along the central axis 70 of discharge passageway 58. The included angle $\alpha$ between lines 66 and 70 as shown in FIG. 2 is preferably 46° 0′. The shortest distance 72 between point 74 on exterior side wall 64 and reference line 66 is 1.319 inches. The angle $\beta$ between a reference line 76 tangent to exterior side wall 64 at point 74 and reference line 70 is 55°.

As also shown in FIGS. 2–4, a pair of fuel jets 78 are formed in the outer ring portion 46 of nozzle 18 to conduct pressurized fuel from fuel plenum 34 to each discharge passageway 58. In the illustrated embodiment, thirty-two fuel jets 78 are used to supply fuel to mixing regions 80 provided in each of the sixteen discharge passageways 58. Illustratively, each set of fuel jets 78 includes a pair of straight passageways aligned in spaced-apart parallel relation and arranged to extend in parallel relation to the central axis 68 of the nozzle 8. For example, natural gas or liquid propane gas at a pressure of one pound per square inch could be delivered by fuel supply line 24 to fuel plenum 34 and then into the mixing region 80 provided in each of the discharge passageways 58 by the fuel jets 78.

The combustion air supplied from air plenum 32 mixes with fuel supplied from fuel plenum 34 in the mixing regions 80 located in each of discharge passageways 58. The fuel jets 78 and the discharge passageways 58 are sized and the pressures and velocities of fuel and air selected to cause a fuel-lean air and fuel mixture to be created in each of the mixing regions in the discharge passageways 58. In a preferred embodiment, the air and fuel mixture has an air-to-fuel ratio that is greater than 15 to 1.

Although suitable mixing can take place with only one fuel jet 78 per discharge passageway 58, it is advantageous to provide two fuel jets 78 per discharge passageway 58 and arrange those two fuel jets 78 on opposite sides of the central axis 79 of the discharge passageway 58 as shown, for example, in FIG. 2. This offset fuel jet arrangement helps to stimulate mixing of air and fuel in mixing region 80 and leads to a more uniform distribution of air and fuel in the mixture passing through discharge passageway 58. These offset fuel jets 78 provide means for keeping fuel admitted into discharge passageway 58 from crowding to one side of the channel and providing a stoichiometric pocket or a fuel-rich pocket in the discharge passageway 58. Advantageously, zones or pockets of (1) perfect or stoichiometric air and fuel mixtures or (2) fuel-rich air and fuel mixtures in the nozzle 18 and in cyclonic combustion chamber 14 can be eliminated or reduced using this nozzle configuration. This permits a more uniformly cool flame and helps to eliminate hot spots in the combustion chamber 14 that might lead to unwanted emissions of oxides of nitrogen. While all of the fuel jets 78 are located at a constant radial distance from center point 68 as shown best in FIG. 4, it is within the scope of this invention to stagger those radial distances slightly to vary the air and fuel distribution at each mixing region 80.

Referring now to FIG. 4, a variety of angular relationships are illustrated to define the location of fuel jets 78 in a presently preferred embodiment of the invention. It will be understood by those of ordinary skill in the art that these locations can be varied somewhat to suit any specific application. The included angle $\phi$ between radially extending reference lines 82 and 84 originating at center point 68 and passing through adjacent fuel jets 78 is 10° 50′. Angle $\theta_1$ is 3° 22′ and angle $\theta_2$ is 22° 30′.

In operation, a fuel-lean air and fuel mixture is injected by nozzle 18 with a tangential and perhaps a radial and/or axial component of velocity into cyclonic combustion chamber 14 on the basis of heat release per cubic foot of volume of chamber 14. Combustion air flows through the plurality of angled passageways 58 and fuel is injected into the air at mixing region 80 to produce this fuel-lean mixture. The velocity of the air at mixing region 80 is sufficient to prevent burning within nozzle 80 and cause an unburned swirling fuel-lean air and fuel mixture to be discharged into the cyclonic combustion chamber 14. Fuel-lean operation yields low flame temperatures to minimize or reduce the emissions of oxides of nitrogen. This cyclonic combustor assembly 10 is well suited for providing a low emission burner for oven heating, furnace heating, indirect heating, fume incineration, and make-up air heating.

Figure 6:
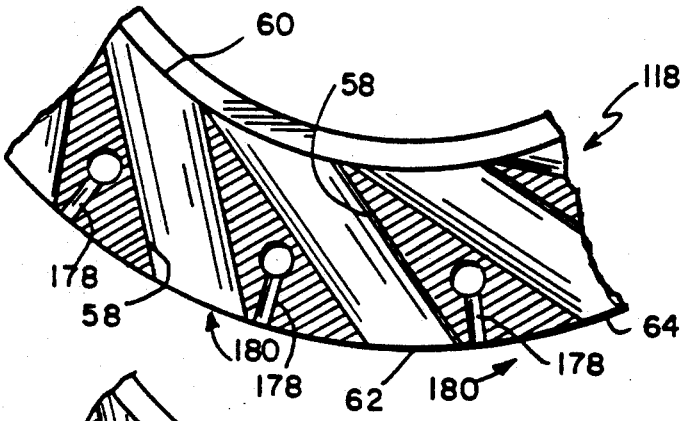
FIG. 6 is a view of a portion of a second nozzle body showing another arrangement of fuel jets and discharge passageways.
Figure 7:
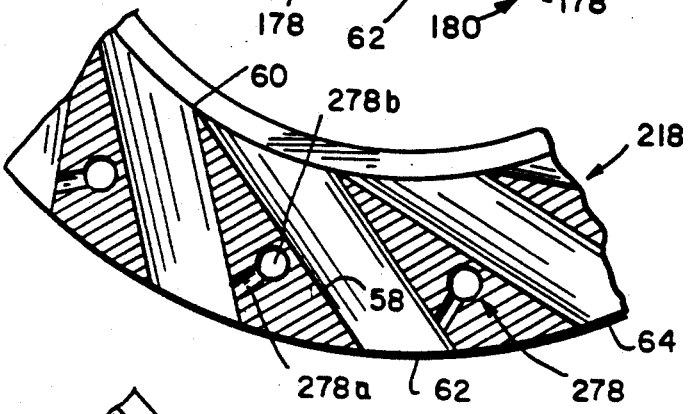
FIG. 7 is a view of a portion of a third nozzle body showing yet another arrangement of fuel jets and discharge passageways.
Figure 8:
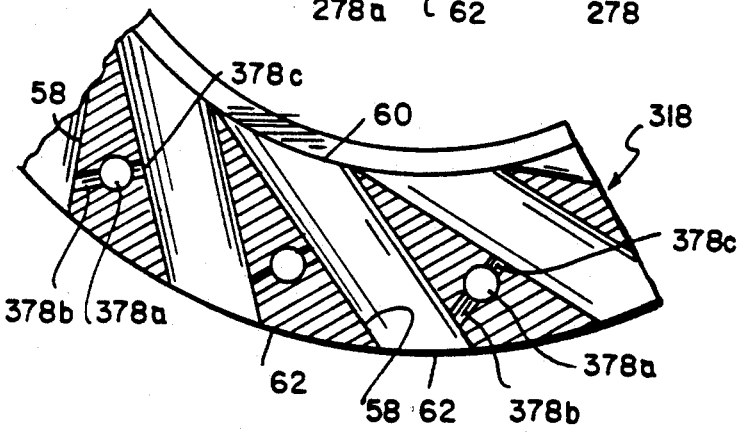
FIG. 8 is a view of a portion of a fourth nozzle body showing still another arrangement of fuel jets and discharge passageways.

Other embodiments of cyclonic combustor nozzles are shown in FIGS. 6–8. A nozzle 118 in which a single fuel jet 178 is arranged to cause air from discharge passageway 58 to mix with fuel from fuel jet 178 in a mixing region 180 just outside the outlet 62 of passageway 58 and alongside the exterior side wall 64 of nozzle 118 is shown in FIG. 6. A nozzle 218 in which a single fuel jet 278 is arranged to cause air in discharge passageway 58 to mix with fuel from fuel jet 278 in mixing region 280 inside passageway 58 is shown in FIG. 7. Fuel jet 278 includes a main branch **278*a* coupled to fuel plenum 34 and a side branch 278 lying at a right angle to main branch 278*a* and connecting to passageway 58. A nozzle 318 in which a main fuel jet branch 378*a* is provided between each pair of adjacent discharge passageways and a pair of side fuel jet branches 378*b, c* are used to emit streams of fuel from main fuel jet branch 378*a* into each of the adjacent discharge passageways 58 is shown in FIG. 8. This is another illustration of a twin fuel jet system that can be used to provide a uniform distribution of air and fuel within the passageway 58 (and ultimately the cyclonic combustion chamber 14) to provide a uniformly low flame temperature in the cyclonic combustor assembly 10**.

Figure 5A:
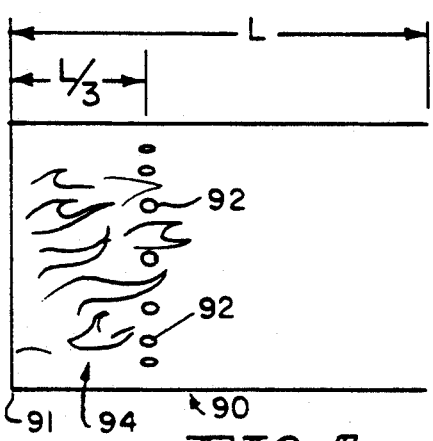
FIG. 5*a* is a diagrammatic view of another embodiment of a cyclonic combustor showing a plurality of noise attenuation tuning holes.
Figure 5B:
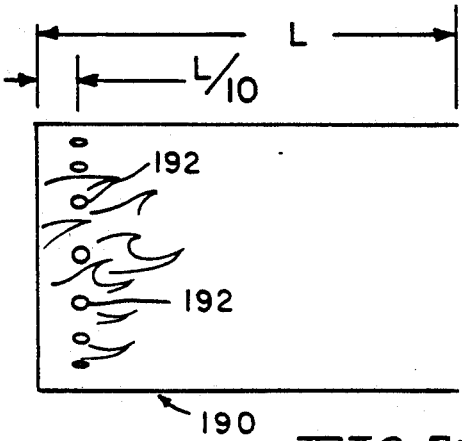
FIG. 5*b* is a diagrammatic view of another embodiment of a cyclonic combustor showing a plurality of noise attenuation tuning holes.

A noise suppression system for use in a burner having a housing 90 of length "L" is diagrammatically shown in FIG. **5*a*. This housing 90 could be the housing of a cyclonic combustor or another housing of similar shape. Referring to FIG. 5*a*, a multiplicity of holes 92 is formed in housing 90 at a distance of "L/3" from the plane 91 at which an air and fuel mixture is introduced into the housing 90 and ignited to produce flame 94. Preferably, the diameter of each hole 92 is about two percent of the internal diameter of the housing 90. These holes 92 advantageously "tune" the can to a higher natural frequency (about one octave) which decouples the resonance between the air and fuel injection holes and the housing 90. Referring to FIG. 5*b*, another embodiment of a housing 190 is illustrated wherein the multiplicity holes 192 are located within the first ten percent of the axial length of the housing 190 referenced from the nozzle end of housing 190**.

Figure 9:
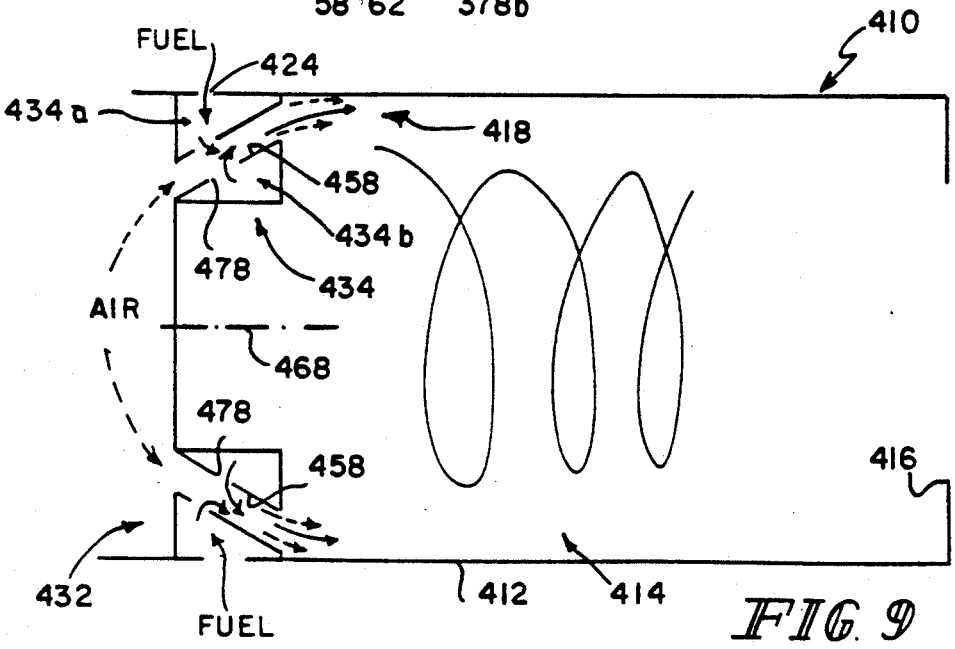
FIG. 9 is a diagrammatic view of another embodiment of a cyclonic combustor nozzle.
Figure 11:
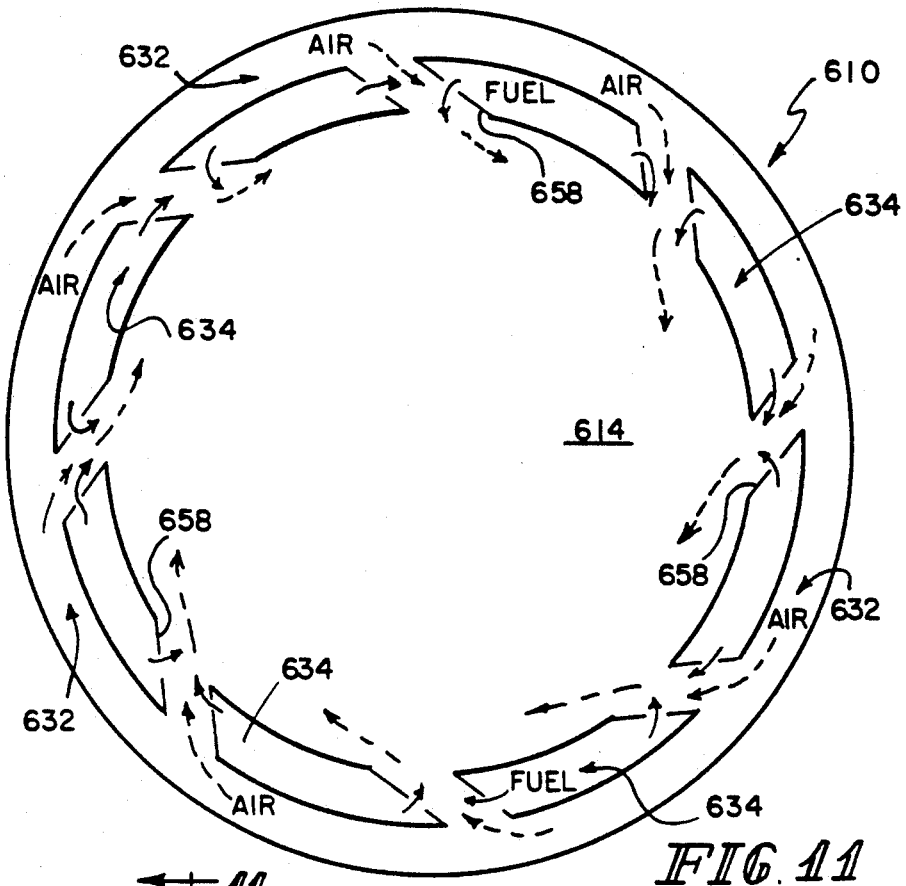
FIG. 11 is a sectional view of the nozzle of FIG. 10 taken along line 11—11 of FIG. 10.
Figure 10:
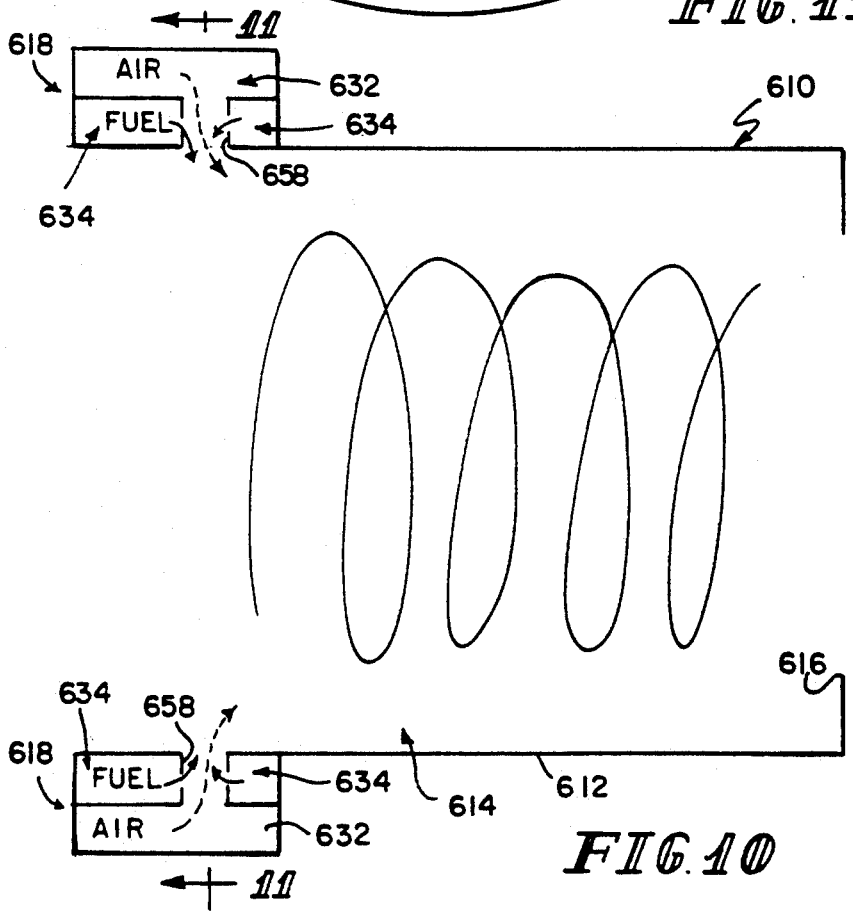
FIG. 10 is a diagrammatic view of yet another embodiment of a cyclonic combustor nozzle.

Several other embodiments of an air and fuel mixing nozzle for use in a cyclonic combustor assembly are shown diagrammatically in FIGS. 9–11. In each embodiment, the air-to-fuel ratio is set to produce a fuel-lean air and fuel mixture that is discharged into a downstream cyclonic combustion chamber to yield a low flame temperature and low emissions of oxides of nitrogen and other contaminates as described in reference to the embodiment of FIGS. 1–4.

Referring to FIG. 9, a cyclonic combustor assembly 410 includes a combustor housing 412 providing a cyclonic combustion chamber 414, an exhaust outlet 416, and a nozzle 418. The nozzle 418 is formed to include a plurality of discharge passageways 458 arranged at compound angles about the central axis 468 of nozzle 418 in a diverging cone-shaped pattern as shown in FIG. 9. The passageways 458 extend through an annular fuel plenum 434 that includes a radially outer portion **434*a* and a radially inner portion 434*b*. Fuel is supplied to fuel plenum 434 through a side inlet 424. Combustion air is supplied to each discharge passageway 458 by means of an air plenum 432 upstream of the nozzle 418 as shown in FIG. 9. Fuel is supplied by one or more fuel jets 478 which are formed in the side walls of discharge passages 458 and arranged to conduct fuel from fuel plenum 434 into each of the discharge passages 458**.

Referring to FIGS. 10 and 11, a nozzle 618 located outside a cyclonic combustion chamber 614 is used to supply an unburned swirling fuel-lean air and fuel mixture into the combustion chamber 614. The cyclonic combustor assembly 610 includes a combustor housing 612 providing a cyclonic combustion chamber 614 and an exhaust outlet 616. The nozzle 618 is formed to include a plurality of radially inwardly extending, angled discharge passageways 658 arranged as shown in FIGS. 12 and 13 to conduct combustion air from a radially outwardly situated, ring-shaped air plenum 632 into the cyclonic combustion chamber 614. A ring-shaped fuel plenum 634 is located between the air plenum 632 and the housing 612 as shown in FIGS. 12 and 13. Fuel is supplied by one or more fuel jets 678 which are formed in the side walls of discharge passages 658 and arranged to conduct fuel from fuel plenum 634 into each of the discharge passageways 658.

Although the invention has been described in detail with reference to certain preferred embodiments and specific examples, variations and modifications exist within the scope and spirit of the invention as described and defined in the following claims.

We claim:

1. A cyclonic combustor nozzle for mixing air and fuel to produce a combustible lean air and fuel mixture in a cyclonic combustion chamber of a cyclonic combustor, the cyclonic combustor nozzle comprising a nozzle body including a radially outwardly facing, exterior side wall and end wall, means for partitioning the nozzle body to provide a plurality of separate air and fuel mixing chambers arranged in spaced-apart relation inside the nozzle body and each extending through the exterior side wall, air-providing means in the nozzle body for providing combustion air to each of the separate air and fuel mixing chambers, fuel-delivering means in the nozzle body for delivering fuel at a predetermined rate to each of the separate air and fuel mixing chambers to mix with combustion air in each of the separate air and fuel mixing chambers to produce a fuel-lean air and fuel mixture in each of the separate air and fuel mixing chambers, and means in the nozzle body for discharging the fuel-lean air and fuel mixture through the radially outwardly facing, exterior side wall from each of the air and fuel mixing chambers and the nozzle body to produce cyclonic flow of the fuel-lean air and fuel mixture for discharge into a cyclonic combustion chamber so that the fuel-lean air and fuel mixture yields a low flame temperature once ignited in the cyclonic combustion chamber, thereby leading to low emissions of oxides of nitrogen and other contaminants.

2. The cyclonic combustor nozzle of claim 1, wherein the fuel-delivering means and the air-providing means cooperate to produce an unburned fuel-lean air and fuel mixture having an air-to-fuel ratio greater than 15 to 1 in each separate air and fuel mixing chamber in the nozzle body.

3. A cyclonic combustor nozzle for mixing air and fuel to produce a combustible lean air and fuel mixture in a cyclonic combustion chamber of a cyclonic combustor, the cyclonic combustor nozzle comprising a nozzle body including an exterior side all and end wall, means for providing a plurality of air and fuel mixing regions inside the nozzle body, air-providing means in the nozzle body for providing combustion air to each of the air and fuel mixing regions, fuel-delivering means in the nozzle body for delivering fuel at a predetermined rate to mix with combustion air in each of the air and fuel mixing regions to produce a fuel-lean air and fuel mixture in each of the air and fuel mixing regions, and means in the nozzle body for discharging the fuel-lean air and fuel mixture through the exterior side wall from each of the air and fuel mixing regions and the nozzle body to produce cyclonic flow of the fuel-lean air and fuel mixture for discharge into a cyclonic combustion chamber so that the fuel-lean air and fuel mixture yields a low flame temperature once ignited in the cyclonic combustion chamber, thereby leading to low emissions of oxides of nitrogen and other contaminants, the low nozzle body being formed to include an air plenum and an annular fuel plenum surrounding the air plenum, the discharging means including a plurality of discharge passageways formed in the nozzle body and arranged to conduct air from the air plenum into the cyclonic combustion chamber without passing through the fuel plenum, and one of the plurality of air and fuel mixing regions being located in each of the discharge passageways.

4. The cyclonic combustor nozzle of claim 3, wherein the fuel-delivering means includes at least one fuel jet conducting fuel from the fuel plenum into the air and fuel mixing region of each discharge passageway to establish an unburned fuel-lean air and fuel mixture in each discharge passageway.

5. The cyclonic combustor nozzle for mixing air and fuel to produce a combustible lean air and fuel mixture in a cyclonic combustion chamber of a cyclonic combustor, the cyclonic combustor nozzle comprising a nozzle body, means for providing a plurality of air and fuel mixing regions inside the nozzle body, air-providing means in the nozzle body for providing combustion air to each of the air and fuel mixing regions, fuel-delivering means in the nozzle body for delivering fuel at a predetermined rate to mix with combustion air in each of the air and fuel mixing regions to produce a fuel-lean air and fuel mixture in each of the air and fuel mixing regions, and means in the nozzle body for discharging the fuel-lean air and fuel mixture from each of the air and fuel mixing regions and the nozzle body to produce cyclonic flow of the fuel-lean air and fuel mixture in a cyclonic combustion chamber containing the nozzle body so that the fuel-lean air and fuel mixture yields a low flame temperature once ignited in the cyclonic combustion chamber, thereby leading to low emissions of oxides of nitrogen and other contaminants, wherein the nozzle body is formed to include an air plenum and an annular fuel plenum surrounding the air plenum, the discharging means includes a plurality of discharge passageways formed in the nozzle body and arranged to conduct air from the air plenum into the cyclonic combustion chamber without passing through the fuel plenum, and one of the plurality of air and fuel mixing regions is located in each of the discharge passageways, the air plenum is round and the nozzle body is formed to arrange the plurality of discharge passageways in an outwardly extending, pinwheel-shaped pattern about the round air plenum and adjacent to the annular fuel plenum.

6. The cyclonic combustor nozzle of claim 5, wherein the air and fuel mixing regions are situated to lie in the discharge passageways at about a uniform radial distance from a point at the center of the round air plenum to establish a ring of circumferentially spaced-apart air and fuel mixing regions in the air discharge passageways and adjacent to the annular fuel plenum.

7. A cyclonic combustor nozzle for mixing air and fuel to produce a combustible lean air and fuel mixture in a cyclonic combustion chamber of a cyclonic combustor, the cyclonic combustor nozzle comprising a nozzle body, means for providing a plurality of air and fuel mixing regions inside the nozzle body, air-providing means in the nozzle body for providing combustion air to each of the air and fuel mixing regions, fuel-delivering means in the nozzle body for delivering fuel at a predetermined rate to mix with combustion air in each of the air and fuel mixing regions to produce a fuel-lean air and fuel mixture in each of the air and fuel mixing regions, and means in the nozzle body for discharging the fuel-lean air and fuel mixture from each of the air and fuel mixing regions and the nozzle body to produce cyclonic flow of the fuel-lean air and fuel mixture in a cyclonic combustion chamber containing the nozzle body so that the fuel-lean air and fuel mixture yields a low flame temperature once ignited in the cyclonic combustion chamber, thereby leading to low emissions of oxides of nitrogen and other contaminants, the fuel-delivering means including first fuel jet means for emitting a first stream of fuel into each of the air and fuel mixing regions to mix with air therein and second fuel jet means for emitting a second stream of fuel into each of the air and fuel mixing regions to mix with air therein so that a uniform distribution of air and fuel is established in each air and fuel mixing region to minimize the oxides of nitrogen and other contaminants produced in the cyclonic combustion chamber upon ignition of the fuel-lean air and fuel mixture discharged from the plurality of air and fuel mixing regions into the cyclonic combustion chamber, the nozzle body being formed to include a plurality of tubular passageways coupled to the air-providing means to establish an air and fuel mixing region in each of the tubular passageways, each tubular passageway being coupled in fluid communication to the discharging means and includes a central axis extending therethrough, the first fuel jet means being configured to inject the first stream of fuel into each tubular passageway to reach a first portion of the air and fuel mixing region in the tubular passageway on one side of the central axis, and the second jet means being configured to inject the second stream of fuel into each tubular passageway to reach a second portion of the air and fuel mixing region in the tubular passageway on an opposite side of the central axis.

8. The cyclonic combustor nozzle of claim 1, wherein the air-providing means is configured to conduct air through each of the separate air and fuel mixing chambers and the discharging means at a predetermined velocity sufficient to prevent burning of the air and fuel mixture within the nozzle body.

9. A cyclonic combustor nozzle for mixing air and fuel to produce a combustible fuel-lean air and fuel mixture in a cyclonic combustion chamber of a cyclonic combustor, the cyclonic combustor nozzle comprising a nozzle body formed to include fuel chamber means for receiving a supply of fuel and air chamber means for receiving a supply of combustion air, means for conducting combustion air through the nozzle body from the air chamber means into the cyclonic combustion chamber at a predetermined velocity, and fuel jet means for delivering fuel from the fuel chamber means through the nozzle body into the conducting means to mix with combustion air passing at a predetermined velocity from the air chamber means into the cyclonic combustion chamber to produce an unburned fuel-lean air and fuel mixture in the conducting means for discharge into the cyclonic combustion chamber so that the fuel-lean air and fuel mixture yields a low flame temperature once ignited in the cyclonic combustion chamber, wherein the air chamber means includes a round air plenum and the fuel chamber means includes an annular fuel plenum surrounding the round air plenum, and wherein the conducting means includes a plurality of angled radially outwardly extending tubular passageways, each tubular passageway has an inlet opening into the air plenum and an outlet formed in an exterior surface of the nozzle body, the fuel jet means includes at least one fuel jet for each tubular passageway, and each fuel jet has an inlet opening into the fuel plenum and an outlet opening into one of the tubular passageways.

10. A cyclonic combustor nozzle for mixing air and fuel to produce a combustible fuel-lean air and fuel mixture in a cyclonic combustion chamber of a cyclonic combustor, the cyclonic combustor nozzle comprising a nozzle body including a radially outwardly facing exterior side wall and an end wall and formed to include fuel chamber means for receiving a supply of fuel and air chamber means for receiving a supply of combustion air, means for conducting combustion air through the nozzle body and the radially outwardly facing exterior side wall of the nozzle body from the air chamber means into the cyclonic combustion chamber at a predetermined velocity to produce cyclonic flow for discharge into a cyclonic combustion chamber, and fuel jet means for delivering fuel from the fuel chamber means through the nozzle body into the conducting means to mix with the cyclonic flow of combustion air passing at a predetermined velocity from the air chamber means into the cyclonic combustion chamber to produce an unburned fuel-lean air and fuel mixture in the conducting means for discharge into the cyclonic combustion chamber so that the cyclonic flow of the fuel-lean air and fuel mixture yields a low flame temperature once ignited in the cyclonic combustion chamber, the nozzle body having an annular inner wall defining a side wall boundary of the air chamber means and an annular outer wall defining the exterior side wall of the nozzle body, the conducting means including a plurality of discharge passageways formed in the nozzle body and arranged in a pinwheel-shaped pattern around the air chamber means, and each discharge passageway including an inlet port formed in the annular inner wall to open into the air chamber means and an outlet port formed in the annular outer wall to open into the cyclonic combustion chamber.

11. The cyclonic combustor nozzle of claim 10, wherein the fuel jet means includes a plurality of conduits and each of the conduits is formed in the nozzle body and is arranged to conduct fuel from the fuel chamber means to one of the discharge passageways in the nozzle body.

12. The cyclonic combustor nozzle of claim 10, wherein the fuel jet means includes a plurality of pairs of conduits and each pair of conduits is formed in the nozzle body and arranged in spaced-apart relation to conduct fuel from the fuel chamber means to one of the discharge passageways formed in the nozzle body.

13. The cyclonic combustor nozzle of claim 10, wherein the air chamber means includes a round air plenum and the fuel chamber means includes an annular fuel plenum surrounding the round air plenum.

14. A cyclonic combustor nozzle for mixing air and fuel to produce a combustible fuel-lean air and fuel mixture in a cyclonic combustion chamber of a cyclonic combustor, the cyclonic combustor nozzle comprising a nozzle body including an exterior side wall and an end wall and formed to include fuel chamber means for receiving a supply of fuel and air chamber means for receiving a supply of combustion air, means for conducting combustion air through the nozzle body from the exterior side wall of the nozzle body from the air chamber means into the cyclonic combustion chamber at a predetermined velocity, and fuel jet means for delivering fuel from the fuel chamber means through the nozzle body into the conducting means to mix with combustion air passing at a predetermined velocity from the air chamber means into the cyclonic combustion chamber to produce an unburned fuel-lean air and fuel mixture in the conducting means for discharge into the cyclonic combustion chamber so that the fuel-lean air and fuel mixture yields a low flame temperature once ignited in the cyclonic combustion chamber, wherein the nozzle body has an annular inner wall defining a side wall boundary of the air chamber means and an annular outer wall defining the exterior side wall of the nozzle body, the conducting means includes a plurality of discharge passageways formed in the nozzle body, and each discharge passageway includes an inlet port formed in the annular inner wall to open into the air chamber means and an outlet port formed in the annular outer wall to open into the cyclonic combustion chamber, each discharge passageway being straight and including a central axis extending therethrough and intersecting a line tangent to the annular outer wall to define a predetermined acute angle therebetween.

15. The cyclonic combustor nozzle of claim 14, wherein said predetermined acute angle is about 55°.

16. The cyclonic combustor nozzle of claim 10, wherein the nozzle body further includes an end plate arranged to define the end wall and a bottom wall boundary of the air chamber means.

17. The cyclonic combustor nozzle of claim 16, wherein each discharge passageway is arranged to lie in spaced-apart parallel relation to the end plate.

18. The cyclonic combustor nozzle of claim 10, wherein the fuel jet means is configured to deliver fuel into the conducting means to produce a fuel-lean air and fuel mixture having an air-to-fuel ratio greater than 15 to 1 in the conducting means.

19. A cyclonic combustor nozzle for mixing air and fuel to produce a combustible fuel-lean air and fuel mixture in a cyclonic combustion chamber of a cyclonic combustor, the cyclonic combustor nozzle comprising a ring portion formed to include a central air plenum and an annular fuel plenum around the air plenum nd means for discharging air from the air plenum into a cyclonic combustion chamber through a plurality of outwardly extending discharge passageways arranged in a pinwheel-shaped pattern about the central air plenum at angles to a radius of the ring to establish a swirling cyclonic air flow pattern in the cyclonic combustion chamber, and fuel jet means extending through the ring portion for delivering fuel from the fuel plenum at a predetermined rate to mix with air discharged through the discharge passageways to produce a fuel-lean swirling air and fuel mixture in the combustion chamber of the cyclonic combustor so that the fuel-lean air and fuel mixture yields a low flame temperature once ignited in the cyclonic combustion chamber.

20. The cyclonic combustor nozzle of claim 19, wherein the jet means includes two fuel jets discharging streams of fuel from the fuel plenum into the air discharge passageway to produce a fuel-lean air and fuel mixture in each air discharge passageway.

21. The cyclonic combustor nozzle of claim 20, wherein each air discharge passageway includes a central axis and the two fuel jets for each air discharge passageway are arranged in spaced-apart relation to lie on opposite sides of the central axis.

22. The cyclonic combustor of claim 21, wherein the fuel jets are arranged in a circular pattern about a point at the center of the central air plenum to lie in circumferentially spaced-apart relation to one another.

23. The cyclonic combustor of claim 20, wherein the fuel jets are arranged in a circular pattern about a point at the center of the central air plenum to lie in circumferentially spaced-apart relation to one another.

24. The cyclonic combustor nozzle of claim 19, wherein the fuel jet means includes a single fuel jet for each air discharge passageway.

25. The cyclonic combustor nozzle of claim 24, wherein each single jet is arranged in the ring portion to emit a single stream of fuel from the fuel plenum into its air discharge passageway to produce a fuel-lean air and fuel mixture in the air discharge passageway.

26. The cyclonic combustor nozzle of claim 24, wherein each air discharge passageway includes an air outlet formed in an outer wall of the ring portion to open into the combustion chamber and each single jet is arranged in the ring portion to emit a single stream of fuel from the fuel plenum through a fuel outlet formed in the outer wall of the ring to lie adjacent to a companion air outlet to produce the fuel-lean air and fuel mixture outside of the air discharge passageway.

27. The cyclonic combustor nozzle of claim 19, wherein the fuel jet means includes a plurality of fuel conduits coupled to the fuel plenum and arranged to extend at right angles to the air discharge passageways and one fuel conduit is situated to lie between each pair of adjacent air discharge passageways.

28. The cyclonic combustor nozzle of claim 27, wherein the fuel jet means further includes a single fuel jet opening into each air discharge passageway and said single fuel jet interconnects the air discharge passageway to an adjacent fuel conduit.

29. The cyclonic combustor nozzle of claim 27, wherein the fuel jet means further includes a pair of fuel jets opening into each air discharge passageway, a first of the fuel jets interconnects the air discharge passageway to a first adjacent fuel conduit on one side of the air discharge passageway, and a second of the fuel jets interconnects the air discharge passageway to a second adjacent fuel conduit on another side of the air discharge passageway.

30. The cyclonic combustor nozzle of claim 19, wherein the fuel jet means is configured to deliver fuel at the predetermined rate to establish an unburned fuel-lean air and fuel mixture having an air-to-fuel ratio greater than 15 to 1.

31. The cyclonic combustor nozzle of claim 5, wherein the nozzle body includes an exterior side wall and an end wall and the exterior side wall is formed to include an outlet opening for each of the plurality of discharge passageways.

* * * * *